US010567869B2

(12) United States Patent
Cao et al.

(10) Patent No.: US 10,567,869 B2
(45) Date of Patent: Feb. 18, 2020

(54) SOUND-ABSORBING COMPONENT AND SPEAKER MODULE APPLYING THE SOUND-ABSORBING COMPONENT

(71) Applicant: GOERTEK INC., Shandong (CN)

(72) Inventors: Xiaodong Cao, Shandong (CN); Jinli Liu, Shandong (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 16/098,824

(22) PCT Filed: Dec. 28, 2016

(86) PCT No.: PCT/CN2016/112641
§ 371 (c)(1),
(2) Date: Nov. 2, 2018

(87) PCT Pub. No.: WO2017/190512
PCT Pub. Date: Nov. 9, 2017

(65) Prior Publication Data

US 2019/0208312 A1 Jul. 4, 2019

(30) Foreign Application Priority Data

May 5, 2016 (CN) ..... 2016 1 0293400

(51) Int. Cl.
*H04R 1/28* (2006.01)
*H04R 9/06* (2006.01)
*H04R 1/02* (2006.01)

(52) U.S. Cl.
CPC ..... *H04R 1/288* (2013.01); *H04R 1/025* (2013.01); *H04R 9/06* (2013.01); *H04R 1/2811* (2013.01)

(58) Field of Classification Search
CPC ..... H04R 1/025; H04R 1/288; H04R 9/06
See application file for complete search history.

(56) References Cited

U.S. PATENT DOCUMENTS

2009/0245562 A1* 10/2009 Saiki ..... H04R 1/2803 381/345

FOREIGN PATENT DOCUMENTS

CN 201263207 Y * 6/2009
CN 201263207 Y 6/2009
(Continued)

OTHER PUBLICATIONS

First Office Action, Chinese Application 201610293400.5, State Intellectual Property Office of the P.R. of China, dated May 19, 2017.

(Continued)

*Primary Examiner* — Joshua Kaufman
(74) *Attorney, Agent, or Firm* — Holzer Patel Drennan

(57) ABSTRACT

Disclosed is a sound-absorbing component, comprising a housing and sound-absorbing particles filled in the housing. An antistatic material is added to the materials from which the housing is made, or the antistatic material is coated on the surface of the housing. Also disclosed is a speaker module applying the sound-absorbing component. The sound-absorbing component of the present invention greatly increases the fill rate of the sound-absorbing particles in the housing, thus allowing the space of the rear acoustic cavity of the speaker module applying the sound-absorbing component to be fully utilized, and allowing the sound-absorbing particles to fully exert the effects thereof in improving the acoustic properties of the speaker module.

11 Claims, 2 Drawing Sheets

(56) References Cited

FOREIGN PATENT DOCUMENTS

| | | | | | |
|---|---|---|---|---|---|
| CN | 103763673 | A | | 4/2014 | |
| CN | 204498363 | U | | 7/2015 | |
| CN | 105959882 | A | | 9/2016 | |
| GB | 2213492 | A | * | 8/1989 | ..... C04B 28/26 |
| KR | 20100029266 | A | * | 3/2010 | ..... B01J 2/18 |

OTHER PUBLICATIONS

Second Office Action, Chinese Application 201610293400.5, State Intellectual Property Office of the P.R. of China, dated Nov. 6, 2017.
International Search Report issued for PCT/CN2016/112641 by State Intellectual Property Office of the Peoples Republic of China, dated Mar. 9, 2017.

* cited by examiner

SOUND-ABSORBING COMPONENT AND SPEAKER MODULE APPLYING THE SOUND-ABSORBING COMPONENT

CROSS-REFERENCE TO RELATED APPLICATIONS

The present application is a US national stage entry of International Patent Application Serial No. PCT/CN2016/112641, filed Dec. 28, 2016, which claims priority to Chinese Patent Application Serial No. 201610293400.5, filed May 5, 2016. Each of these applications are hereby incorporated by reference for all that they disclose or teach.

TECHNICAL FIELD OF THE INVENTION

The present invention relates to a technical field of electro-acoustic products, and more particularly, to a sound-absorbing component and a speaker module applying the sound-absorbing component.

BACKGROUND OF THE INVENTION

The speaker module is an important acoustic component of a portable electronic device for converting between an electrical signal and a sound signal, and is an energy conversion device. The existing speaker module generally comprises a module housing and a speaker unit, wherein the module housing forms a module cavity for accommodating the speaker unit therein, and the speaker unit separates the module cavity into a front acoustic cavity and a rear acoustic cavity, and a sound-absorbing component made of a sound absorbing material such as sound absorbing cotton may be disposed in the rear acoustic cavity to adjust the acoustic performance of the module.

In recent years, with the increasing thinness and lightness of wearable electronic products, the sound-absorbing components made of conventional sound absorbing materials have been unable to meet the debugging and calibration requirements of the acoustic performance in the micro speaker industry. In order to solve this problem, new sound absorbing materials are constantly being developed and experimented, and it has been verified that the acoustic performance can be effectively improved by placing porous sound absorbing materials in the rear acoustic cavity of the speaker module. At present, such new sound absorbing materials with good application effects include non-foaming sound absorbing materials such as natural zeolite, activated carbon, white carbon black, silicon dioxide, artificial zeolite, or a mixture of the above two or more materials. When the above-described non-foaming sound absorbing material is applied to the speaker, the above powdery non-foaming sound absorbing material is required to be firstly prepared into sound-absorbing particles having a particle diameter of 0.1 to 1.0 mm for the quantifiability and process filling practicability. According to the size configuration of the rear acoustic cavity of the speaker products, the particle size of the sound-absorbing particles of the non-foaming sound absorbing materials can be selected within a range of 0.1 to 1.0 mm.

At present, the following three methods are generally adopted to manufacture the sound-absorbing component by using the above-mentioned non-foaming sound absorbing materials in the speaker industry.

1. Referring to FIG. 1, a plastic or metal mesh such as PP, PC, PE and the like is formed into a bracket shell 11' that is adapted to the rear acoustic cavity of the speaker module, and then the sound-absorbing particles 13' are loaded into the bracket shell, and finally the bracket shell is packaged with the shell cover 12' by means of gluing, hot-pressing or the like, and the shell cover 12' may be packaged by non-woven fabrics, a Mesh-mesh or a metal mesh, so that the sound-absorbing component is formed;

2. The wire mesh cloth made of PP, PE, etc. is made into a cloth bag by means of gluing, hot-pressing, etc., and then the sound-absorbing particles are placed into the cloth bag, and finally, the package is completed using methods such as gluing and hot-pressing, then the sound-absorbing component is formed;

3. An independent ventilating cavity is constructed in the rear acoustic cavity of the speaker module by a wire mesh cloth, a metal mesh or the like added in the housing of the speaker module in combination with the housing of the speaker module, and then a filling hole is reserved on the independent ventilating cavity in advance to complete the direct filling of the non-foaming sound absorbing material particles, thereby forming the sound-absorbing component.

Since the non-foaming sound absorbing material itself is a porous material and has a high specific surface area, therefore static electricity is easily generated when the non-foaming sound absorbing material comes into contact with air, moreover, the non-foaming sound absorbing material is an insulator, which causes the electric charge to continuously accumulate and the electrostatic effect to continuously enhance. In addition, the porous non-foaming sound absorbing material itself has polar defect point and will be charged itself. Due to the above-described reasons, the electrostatic problem in the filling of the non-foaming sound absorbing material particles occurs, which results in the following adverse effects:

1. In the filling process of the above three application forms of making the sound-absorbing component using the non-foaming sound absorbing material particles, the non-foaming sound absorbing material particles cannot completely fill the predetermined filling area due to the electrostatic repulsion effect between the particles, and the filling amount is small with the fill rate of about 55% to 75%, so that it is difficult to effectively utilize the space of the rear acoustic cavity of the speaker, and the improvement effect on the acoustic performance of the speaker is significantly restrained;

2. Since the non-foaming sound absorbing material particles are prone to generate static electricity, when the particles are packaged to form a sound-absorbing component after filling, a certain number of particles may enter into the package area, causing failure of the packaging operation and low package yield, or affecting the package strength, and, the package is easily damaged in the working process of the speaker module due to factors such as aging and external forces, resulting in leakage of sound-absorbing particles and thereby affecting the acoustic quality of the speaker.

SUMMARY OF THE INVENTION

Technical Problems

The technical problem to be solved by the present invention is to provide a sound-absorbing component capable of greatly improving the fill rate of sound-absorbing particles, and to provide a speaker module which comprises a sound-absorbing component with good sound absorbing effect in the rear acoustic cavity.

Technical Solutions

A sound-absorbing component comprising a housing and sound-absorbing particles filled in the housing, wherein an antistatic material is added into a material of the housing, or the antistatic material is coated on a surface of the housing.

Preferably, the antistatic material is a conductive material or an antistatic agent.

Preferably, surfaces of the sound-absorbing particles are coated with electric inductive metal films or sprayed with the antistatic agent, and the material of the electric inductive metal films is one of a metal block polymer of polyether, glycerol-stearate or a derivative of ethylene oxide.

Preferably, surfaces of the sound-absorbing particles are subjected to a polishing treatment and a powder falling rate wt % is 0.1.

Preferably, the conductive material is one or more of carbon black, metal and metal oxide.

Preferably, the antistatic agent is one or more of quaternary ammonium salts, phosphates, fatty acid esters, ammonium ethoxide, alkyl sulfonates and acrylic acid derivatives.

Preferably, an antistatic material is added into the material of the housing, and the antistatic material is added in an amount of 0.1% to 10% by weight with respect to the material of the housing.

Preferably, the housing comprises a bracket shell and a shell cover which are joined together.

Preferably, a surface of a joint portion of the bracket shell and the shell cover and an inner surface of the shell cover are coated with the antistatic material.

Preferably, the housing is a bag shaped structure made of a wire mesh cloth.

A speaker module comprising a module housing and a speaker unit accommodated in the module housing, and the speaker unit separates a module cavity encircled by the module housing into two cavities, a front acoustic cavity and a rear acoustic cavity, and a sound-absorbing component is disposed in the rear acoustic cavity, the sound-absorbing component is any one of the sound-absorbing components described above.

Advantageous Effects

The sound-absorbing component of the present invention comprises a housing and sound-absorbing particles filled in the housing, wherein an antistatic material is added into a material of the housing, or the antistatic material is coated on a surface of the housing, and the antistatic material is a conductive material or an antistatic agent. Such structure can improve the electrostatic properties of the housing, enhance the antistatic capability of the housing, and greatly increase the fill rate of the sound-absorbing particles in the housing, so that the space of the rear acoustic cavity of the speaker module applying the sound-absorbing component can be fully utilized, and the sound-absorbing particles can fully exert the effect of improving the acoustic performance of the speaker module, and it is more conductive to the reduction of the speaker module F0. Meanwhile, the effective elimination of static electricity prevents the sound-absorbing particles from adhering to the package area of the housing, thereby greatly reducing the problem of poor package strength due to the inclusion of sound-absorbing particles in the package area, and making the package area of the housing not easily to be damaged and leak, and increasing the package yield which can be increased to 95%, improving the service life of the speaker module, and reducing the use-cost of the speaker module.

Surfaces of the sound-absorbing particles are coated with electric inductive metal films or sprayed with an antistatic agent to provide surface conductivity of the sound-absorbing particles, further improve the electrostatic properties, and increase the fill rate of the sound-absorbing particles in the housing and the package yield of the sound-absorbing component.

In the sound-absorbing component of the present invention, when the material for forming the housing is mixed with the antistatic material, the housing itself has electrical conductivity, thereby improving the antistatic property of the housing, and making the subsequent surface cleaning operation to the housing not affect the antistatic effect of the housing, and achieving a durable antistatic effect of the housing.

REFERENCE NUMERAL

1: sound-absorbing component; 11: bracket shell; 11': bracket shell; 12: shell cover; 12': shell cover; 13: sound-absorbing particles; 13': sound-absorbing particles; 14: antistatic material; 15: cloth bag.

DETAILED DESCRIPTION OF EMBODIMENTS OF THE INVENTION

In order to make the purposes, technical solutions and advantages of the present invention clear, the present invention will be further described in detail below in combination with the accompanying drawings and embodiments. It is to be understood that the specific embodiments described herein are merely illustrative of the invention and are not intended to limit the invention.

The First Embodiment

Figure 1:
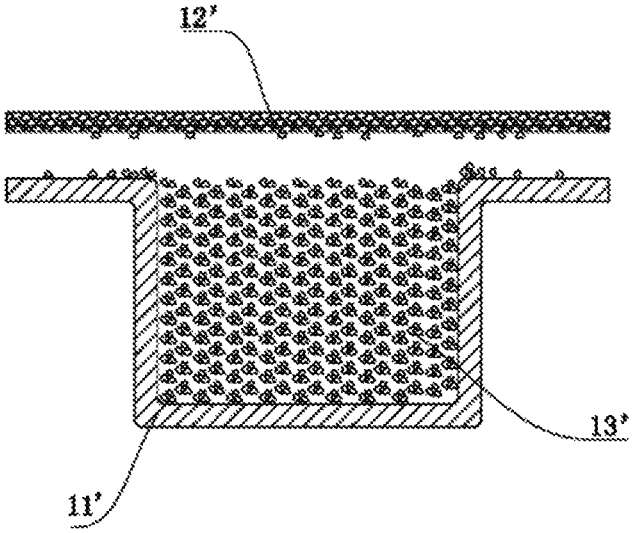
FIG. 1 is a structural schematic diagram of a conventional sound-absorbing component.
Figure 2:
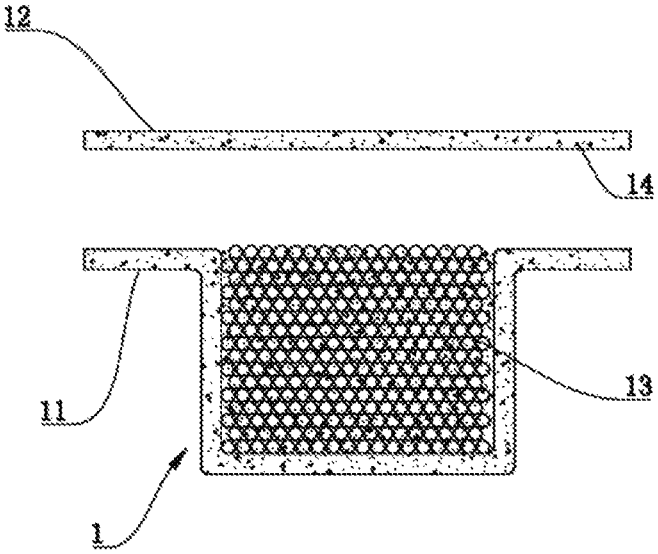
FIG. 2 is a structural schematic diagram of a sound-absorbing component according to a first embodiment of the present invention.

Referring to FIG. 2, in the embodiment, the sound-absorbing component 1 comprises a housing including a bracket shell 11 and a shell cover 12 which are joined together. The bracket shell 11 is filled with sound-absorbing particles 13, and the sound-absorbing particles 13 may be sound-absorbing particles made of a non-foaming sound absorbing material, the materials for forming the bracket shell 11 and the shell cover 12 are mixed with an antistatic material 14, and the bracket shell 11 and the shell cover 12 are respectively formed in manner of mixed refining by using forming materials mixed with the antistatic material 14, and the antistatic material is added in an amount of 0.1% to 10% by weight with respect to the material of the housing.

The antistatic material may be a conductive material or an antistatic agent. The conductive material may be one or more of conductive materials such as carbon black, metal and metal oxide and the like; the antistatic agents may be one or more of surfactants such as quaternary ammonium salts, phosphates, fatty acid esters, ammonium ethoxide, alkyl sulfonates, and polymer surfactants such as acrylic derivatives. By adding the above antistatic materials into the forming materials of the bracket shell 11 and the shell cover 12, the electrostatic properties of the housing can be improved, and the fill rate of the sound-absorbing particles in the housing and the package yield of the sound-absorbing component can be greatly increased.

The surface smoothness of the particles can be improved through the sound-absorbing particles forming or post-treatment process. For example, the sound-absorbing particles are subjected to surface polishing treatment, so that the particle wear rate, i.e., the powder falling rate (wt %) is 0.1, and the accumulation of electric charge due to the friction of the rough surface of the particles is reduced. Alternatively, after the sound-absorbing particles are formed, the surface of the particles is provided with surface conductivity, for example, by coating a layer of an electric inductive metal film or spraying an antistatic agent onto the surface of the particles, as shown in FIG. 2, to increase the surface conductivity of the sound-absorbing particles and enhance antistatic property thereof. Wherein, the material of the electric inductive metal film is one of a metal block polymer of polyether, glycerol-stearate or a derivative of ethylene oxide.

The Second Embodiment

Figure 3:
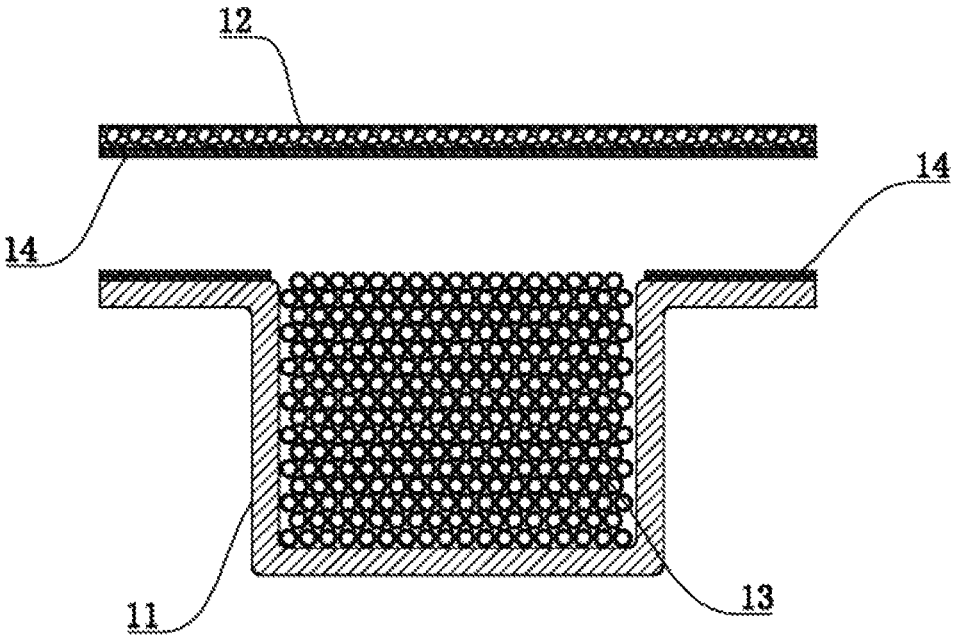
FIG. 3 is a structural schematic diagram of a sound-absorbing component according to a second embodiment of the present invention.

Referring to FIG. 3, the sound-absorbing component of the present embodiment comprises a housing including a bracket shell 11 and a shell cover 12 which are joined together. The bracket shell 11 is filled with sound-absorbing particles 13, and the sound-absorbing particles 13 may be sound-absorbing particles made of a non-foaming sound absorbing material. The surface of the joint portion of the bracket shell 11 and the shell cover 12 and the inner surface of the shell cover 12 are coated with an antistatic material 14. Such structure can increase the surface conductivity of the sound-absorbing component, so that the surface resistance of the area coated with the antistatic material 14 is $\leq 10^{12}\Omega$, thereby achieving the purpose of improving the electrostatic properties of the housing.

The Third Embodiment

Figure 4:
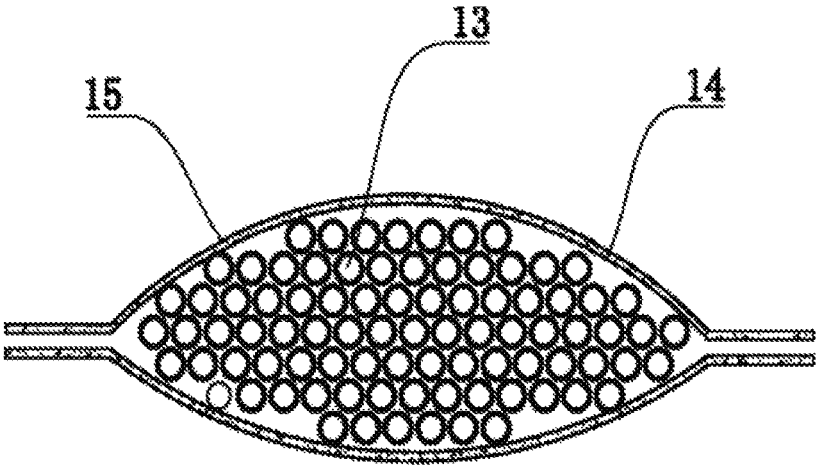
FIG. 4 is a structural schematic diagram of a sound-absorbing component according to a third embodiment of the present invention.

Referring to FIG. 4, the sound-absorbing component of the present embodiment is substantially the same as that of the first embodiment, except that the housing is a cloth bag 15 made of a wire mesh cloth. When making the cloth bag 15, an antistatic material 14 is mixed in the forming material to achieve the purpose of improving the electrostatic properties of the cloth bag, thereby greatly increasing the fill rate of the sound-absorbing particles in the housing and the package yield of the sound-absorbing component. Of course, it is also possible to apply an antistatic material on the surface of the package area or the inner surface of the cloth bag to improve the electrostatic properties of the cloth bag.

The present invention also discloses a speaker module applying the sound-absorbing component described above, wherein the speaker module comprises a module housing and a speaker unit, and a module cavity for accommodating the speaker unit is formed in the module housing, and the speaker unit separates the module cavity into a front acoustic cavity and a rear acoustic cavity, and the rear acoustic cavity is provided with the above sound-absorbing component 1 therein.

The above is examples of preferred embodiments of the present invention, and contents that are not described in detail are common knowledge to those skilled in the art. The scope of the present invention is defined by the appended claims, and any equivalent changes based on the technical enlightenment of the present invention are also within the scope of the present invention.

The invention claimed is:

1. A sound-absorbing component comprising a housing and sound-absorbing particles filled in the housing, wherein an antistatic material is present in at least one of a material of the housing or a coating on a surface of the housing, wherein the sound-absorbing particles comprise a non-foaming sound absorbing material and surfaces of the sound-absorbing particles are coated with a second antistatic material.

2. The sound-absorbing component according to claim 1, wherein the antistatic material is at least one of a conductive material and an antistatic agent.

3. The sound-absorbing component according to claim 2, wherein the conductive material is an electric inductive metal film comprising at least one of a metal block polymer of polyether, glycerol-stearate or a derivative of ethylene oxide.

4. The sound-absorbing component according to claim 1, wherein the surfaces of the sound-absorbing particles are subjected to a polishing treatment and a powder falling rate wt % is $\leq 0.1$.

5. The sound-absorbing component according to claim 2, wherein the conductive material is one or more of carbon black, metal and metal oxide.

6. The sound-absorbing component according to claim 2, wherein the antistatic agent is one or more of quaternary ammonium salts, phosphates, fatty acid esters, ammonium ethoxide, alkyl sulfonates and acrylic acid derivatives.

7. The sound-absorbing component according to claim 1, wherein the antistatic material is added into the material of the housing, and the antistatic material is added in an amount of 0.1% to 10% by weight with respect to the material of the housing.

8. The sound-absorbing component according to claim 1, wherein the housing comprises a bracket shell and a shell cover which are joined together.

9. The sound-absorbing component according to claim 8, wherein a surface of a joint portion of the bracket shell and the shell cover and an inner surface of the shell cover are coated with the antistatic material.

10. The sound-absorbing component according to claim 1, wherein the housing is a bag shaped structure made of a wire mesh cloth.

11. A speaker module comprising a module housing and a speaker unit accommodated in the module housing, and the speaker unit separates a module cavity encircled by the module housing into two cavities, a front acoustic cavity and a rear acoustic cavity, and a sound-absorbing component is disposed in the rear acoustic cavity, wherein the sound-absorbing component is the sound-absorbing component according to claim 1.

* * * * *